United States Patent [19]

Johnson et al.

[11] Patent Number: 4,879,138

[45] Date of Patent: Nov. 7, 1989

[54] COMPOSITION FOR PLASTIC ARTICLE WITH UNITARILY MOLDED FOAM LAYER

[75] Inventors: Marion Johnson, Baytown; Granville J. Hahn; Ramiro V. Ramoos, both of Big Spring, all of Tex.

[73] Assignee: Permian Research Corporation, Big Spring, Tex.

[21] Appl. No.: 348,510

[22] Filed: May 8, 1989

Related U.S. Application Data

[60] Division of Ser. No. 195,094, May 17, 1988, which is a continuation-in-part of Ser. No. 922,127, Oct. 23, 1986, Pat. No. 4,744,478.

[51] Int. Cl.[4] ..... B32B 7/02; B65D 53/00

[52] U.S. Cl. ..... 428/218; 215/252; 215/329; 215/347; 215/348; 428/80; 428/308.4; 428/316.6; 521/91; 521/92; 521/93; 521/94; 521/97; 521/143; 521/908; 521/909; 521/910

[58] Field of Search ..... 428/80, 218, 308.4, 428/316.6; 215/252, 329, 347, 348; 521/91, 92, 93, 94, 97, 143, 908, 909, 910

[56] References Cited

U.S. PATENT DOCUMENTS 3,488,299 1/1970 Sato ..... 521/908
3,558,752 1/1979 Sen ..... 521/908

*Primary Examiner*—Morton Foelak
*Attorney, Agent, or Firm*—Ross, Howison, Clapp & Korn

[57] ABSTRACT

A moldable and foamable thermoplastic composition comprising a major portion of moldable polypropylene resin; from about 1.25 to about 6 parts per hundred of resin (pphr) foam concentrate; from about 0.15 to about 1 pphr calcium carbonate; from about 0.03 to about 0.15 pphr amorphous silicon dioxide; from about 0.1 to about 0.4 pphr lubricant selected from the group consisting of synthetic waxes and distilled monoglycerides; from about 0.1 to about 0.4 pphr lubricant selected from the group consisting of N,N'-dioleoylethylenediamine and calcium stearoyl-2-lactylate; from about 0.15 to about 0.3 pphr unsaturated fatty monoamide; and from about 0.5 to about 2 pphr titanium dioxide concentrate.

13 Claims, 2 Drawing Sheets

COMPOSITION FOR PLASTIC ARTICLE WITH UNITARILY MOLDED FOAM LAYER

CROSS-REFERENCE TO RELATED APPLICATION

This application is a division of application Ser. No. 195,094, filed May 17, 1988, and entitled "Composition For Plastic Article With Unitarily Molded Foam Foyer," which in turn is a continuation-in-part of patent application Ser. No. 06/922,127, filed Oct. 23, 1986, issued May 17, 1988, as U.S. Pat. No. 4,744,478.

TECHNICAL FIELD

This invention relates to molded plastic articles, and more particularly, to plastic closures for glass or plastic containers. One aspect of the invention relates to a container closure comprising a unitarily molded, foamed polymeric sealing layer. Another aspect of the invention relates to a polymeric closure having a unitarily foamed layer that is formed in situ. Still another aspect of the invention relates to a preferred composition of matter that is useful for producing the subject closure.

BACKGROUND OF THE INVENTION

Plastic container closures and, more particularly, plastic closures for carbonated beverage bottles having threaded necks are well known, having previously been disclosed, for example, in U.S. Pat. Nos. 4,310,101; 4,326,639; 4,394,918; 4,461,391; and 4,476,987. Such closures typically employ sealing discs and/or molded flanges which contact the bottle lip to reduce the loss of carbonation. Used alone, integrally molded plastic flanges have not provided the desired sealing characteristics. Although sealing discs have proved to be quite effective for reducing loss of carbonation, they are usually separately manufactured and then inserted into a molded bottle cap, thereby increasing both the time and expense required to produce a satisfactory closure. A unitarily molded plastic bottle cap having satisfactory sealing characteristics is therefore needed, and such a closure is disclosed in U.S. Pat. No. 4,744,478.

In formulating compositions suitable for use in molding polymeric articles, many different factors must be considered. Such factors include, for example, the product configuration, the intended use, the use environment, whether or not the product will contact food or drink intended for human consumption, processing considerations, performance specifications, recyclability, and the like.

Compositions previously known and utilized by others for molding plastic closures for containers such as PET carbonated beverage bottles are not useful for producing closures having an integrally molded, foamed sealing layer as taught in the parent application. A new moldable, foamable, thermoplastic composition that is particularly suitable for molding such closures is therefore needed.

SUMMARY OF THE INVENTION

According to the present invention, a composition is provided that is particularly suitable for use in molding plastic articles having an integrally molded, foamed sealing layer as taught in U.S. Pat. No. 4,744,478.

According to one embodiment of the invention, a composition is disclosed herein that is useful for molding plastic bottle caps adapted to provide sealing engagement with the threaded neck of either a glass or plastic bottle without the need for sealing means as previously required.

According to a preferred embodiment of the invention, a container closure is provided that is molded from a composition comprising a copolymer of polypropylene and rubber, from about 1.25 to about 6 pphr (parts per hundred of resin) of foam concentrate further comprising sodium bicarbonate and citric acid, from about 0.15 to about 1 pphr calcium carbonate, from about 0.03 to about 0.15 pphr amorphous silicon dioxide, from about 0.1 to about 0.4 pphr lubricant selected from the group consisting of synthetic waxes and distilled monoglycerides, from about 0.1 to about 0.4 pphr lubricant selected from the group consisting of N,N'-dioleoylethylenediamine and calcium stearoyl-2-lactylate, from about 0.15 to about 0.3 pphr unsaturated fatty monoamide, and from about 0.5 to about 2 pphr titanium dioxide concentrate.

According to a particularly preferred embodiment of the invention, a container closure is provided that is molded from a composition comprising a copolymer of polypropylene and rubber, about 3 pphr (parts per hundred of resin) of foam concentrate further comprising sodium bicarbonate and citric acid, about 0.2 pphr calcium carbonate, about 0.1 pphr amorphous silicon dioxide, about 0.2 pphr lubricant selected from the group consisting of synthetic waxes and distilled monoglycerides, about 0.2 pphr lubricant selected from the group consisting of N,N'-dioleoylethylenediamine and calcium stearoyl-2-lactylate, about 0.25 pphr unsaturated fatty monoamide, and about 1 pphr titanium dioxide concentrate.

BRIEF DESCRIPTION OF THE DRAWINGS

The plastic closure of the invention is further described and explained in reference to the following drawings wherein.

Like numerals are used to describe like parts in all figures of the drawings.

DETAILED DESCRIPTION OF THE PREFERRED EMBODIMENT

Figure 1:
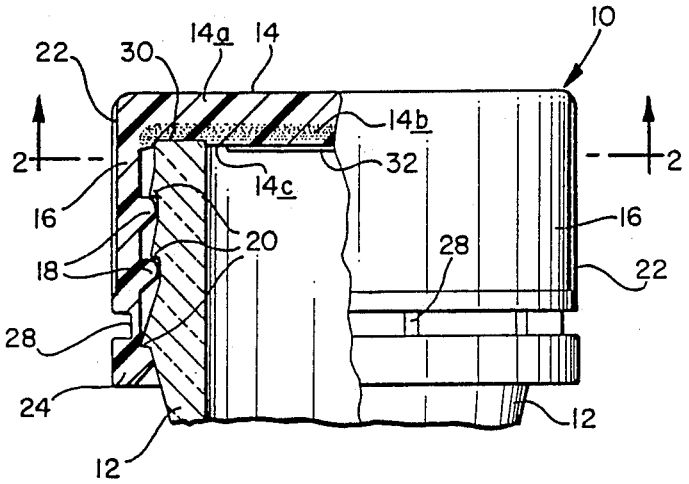
FIG. 1 is a front elevation view, partially in section, of the bottle cap of the invention applied to the neck of a bottle.

Referring to FIG. 1, bottle cap 10 is illustrative of a closure made in accordance with the present invention, and is depicted in threaded engagement with bottle neck 12. For ease of illustration, the remainder of the bottle is broken away. Similarly, in the left half of FIG. 1, a portion of bottle cap 10 and bottle neck 12 are broken away to depict a partial sectional view. Bottle caps made in accordance with the invention are successfully utilized with bottles made cf either glass or plastic.

Bottle cap 10 preferably comprises circular end wall 14 and circumferentially extending side wall 16. End wall 14 preferably further comprises foamed polymer layer **14*b* sandwiched between two relatively denser layers 14*a*, 14*c* of the same polymer. Layer 14*a* is the primary structural layer of end wall 14 and is desirably molded together with side wall 16 to provide a strong, continuous closure capable of withstanding pressures characteristic of the pressures encountered in sealing carbonated beverage containers. According to a preferred embodiment, when threaded onto the neck of a container such as a PET bottle with a torque of about 20 inch-pounds, nominal 28 mm bottle caps 10** weighing about 2.8 grams and made according to the composition of the invention will desirably not leak when subjected a pressure of 100 psi for one minute, and will desirably not blow off when subjected to a pressure of as much as 150 psi for a short period.

The inwardly facing surface of side wall 16 preferably further comprises molded threads 18 which engage threads 20 of bottle neck 12. A plurality of circumferentially spaced ribs 22 are optionally provided on the outwardly facing surface of side wall 16 to assist the consumer in gripping bottle cap 10, although it will be understood by those of skill in the art upon reading this disclosure that knurling or other surface texturing can similarly be imparted to the outwardly facing surface of side wall 16 during the molding process for that purpose.

To provide evidence of tampering, bottle cap 10 preferably further comprises pilfer ring 24, which engages shoulder 26 of bottle neck 12. Pilfer ring 24 is desirably molded together with end wall 14 and side wall 16 of bottle cap 10, and is connected to the lower portion of side wall 16 by a plurality of relatively narrow, circumferentially spaced thermoplastic bridges 28 that are adapted to fail in tension when side wall 16 is rotated so as to remove bottle cap 10 from bottle neck 12. It is understood of course that the configuration of pilfer ring 24 is not critical to use of the present invention, and numerous pilfer ring structures are presently in use and/or described in the prior art.

Referring again to end wall 14, foamed polymer layer **14*b* is desirably disposed between unfoamed layer 14*a*, which has a thickness comparable to that of side wall 16, and layer 14*c*, which comprises a relatively thin skin of unfoamed polymer. According to one embodiment of the invention, the thickness of unfoamed polymer layer 14*a* is about twice the thickness of unfoamed polymer layer 14*c*, and foamed polymer layer 14*b* is about twice the thickness of unfoamed polymer layer 14*a*. The overall thickness of end wall 14 preferably ranges up to about 0.6 cm, with a thickness of about 0.125 inches (0.32 cm) being most preferred for carbonated beverage bottle closures manufactured from polypropylene. It is understood, however, that the thickness of end wall 14 and its constituent layers 14*a*, 14*b*, 14*c* can vary depending on the polymeric resin used, the dimensions and geometry of the container, and the pressures which the closure must withstand during use. The structure of layers 14*a*, 14*b*, 14*c*** and the manner in which they cooperate in the subject closure are further described and explained in relation to the method by which the layers are made.

Bottle cap 10 preferably comprises a major portion of a moldable thermoplastic resin, and most preferably, a major portion of an impact grade copolymer of polypropylene. Impact grade plastics typically comprise a minor amount of rubber such as EPDM or SBR rubber that is copolymerized with the plastic to yield a product having better impact resistance.

According to one preferred embodiment of the invention, a container closure is provided that is molded from a composition comprising a copolymer of polypropylene and rubber, from about 1.25 to about 6 pphr (parts per hundred of resin) foam concentrate further comprising sodium bicarbonate and citric acid, from about 0.15 to about 1 pphr calcium carbonate, from about 0.03 to about 0.15 pphr amorphous silicon dioxide, from about 0.1 to about 0.4 pphr lubricant selected from the group consisting of synthetic waxes and distilled monoglycerides, from about 0.1 to about 0.4 pphr lubricant selected from the group consisting of N,N'-dioleoylethylenediamine and calcium stearoyl-2-lactylate, from about 0.15 to about 0.3 pphr unsaturated fatty monoamide, and from about 0.5 to about 2 pphr titanium dioxide concentrate.

Particularly referred polymeric resins for use in the compositions of the invention are Shell Propylene Copolymer 7912S marketed by Shell Chemicals and El Paso 57S20V Polypropylene marketed by El Paso Products Company. Both resins have a melt flow in the range of from about 20 to about 22 and are modified by the addition of rubber to improve impact properties. When using El Paso 57S20V, the addition of from about 0.1 to about 0.25 pphr sodium benzoate is preferred to serve as a polymer crystal nucleator. The addition of sodium benzoate is not necessary when using Shell 7912S.

The compositions of the invention preferably further comprise from about 1.25 to about 6 pphr, and most preferably about 3 pphr, of foam concentrate containing sodium bicarbonate and citric acid. A preferred foam concentrate for use in the compositions of the invention is XMF 1570 H marketed by Nortech, a division of Enron Chemical Company. XMF 1570 H comprises 50% sodium bicarbonate/citric acid in a low density polyethylene base resin.

The compositions of the invention preferably further comprise from about 0.15 to about 1 pphr, and most preferably about 0.2 pphr, calcium carbonate. A preferred calcium carbonate for use in the compositions of the invention is Omyacarb UF marketed by Omya, Inc.

The compositions of the invention preferably further comprise from about 0.03 to about 0.15 pphr, and most preferably about 0.1 pphr, amorphous silicon dioxide. A preferred silica for use in the compositions of the invention is Cab-O-Sil M-5 marketed by Cabot Corporation.

The compositions of the invention preferably further comprise from about 0.1 to about 0.4 pphr lubricant selected from the group consisting of synthetic waxes and distilled monoglycerides. A preferred synthetic wax for use in the compositions of the invention is Acrawax C (prilled) marketed by Glyco Inc. According to one particularly preferred embodiment of the invention, about 0.2 pphr Acrawax C is utilized in making the subject compositions. When a distilled monoglyceride is selected for use in the compositions of the invention, PATIONIC 901 marketed by Patco Designed Chemicals is preferred. According to one particularly preferred embodiment of the invention, about 0.1 pphr PATIONIC 901 is utilized in making the subject compositions.

The compositions of the invention preferably further comprise from about 0.1 to about 0.4 pphr lubricant selected from the group consisting of N,N'-dioleoylethylenediamine and calcium stearoyl-2-lactylate. A preferred N,N'-dioleoylethylenediamine for use in the compositions of the invention is Glycolube VL (prilled) marketed by Glyco Inc. According to one particularly preferred embodiment of the invention, about 0.2 pphr Glycolube VL is utilized in making the subject compositions. When calcium stearoyl-2-lactylate is selected for use in the compositions of the invention, PATIONIC 930 marketed by Patco Designed Chemicals is preferred. According to one particularly preferred embodiment of the invention, about 0.1 pphr PATIONIC 930 is utilized in making the subject compositions.

The compositions of the invention preferably further comprise from about 0.15 to about 0.3 pphr, and most preferably about 0.25 pphr, unsaturated fatty monoamide. A preferred unsaturated fatty monoamide for use in the compositions of the invention is Kemamide E fatty amide marketed by the Humko Chemical Division of Witco Chemical Corporation.

The compositions of the invention preferably further comprise from about 0.5 to about 2 pphr, and most preferably about 1 pphr, titanium dioxide concentrate. A preferred titanium dioxide concentrate for use in the compositions of the invention is #3015D marketed by Southwest Chemical. While this material is preferred for use in a composition for making a white closure such as a bottle cap, it is understood that other similar pigments can also be utilized within the scope of the invention for making products of other colors. In addition to functioning as a pigment within the composition, it is also believed that the titanium dioxide concentrate of the preferred embodiment also functions as a nucleator and lubricant.

To manufacture a closure such as a bottle cap utilizing the composition of the invention, a masterbatch is desirably prepared in which the thermoplastic resin and other preferred additives are combined in a hopper and extruded together to obtain good dispersion of the additives throughout the thermoplastic melt. The extrudate is pelletized and stored until use. At the time of use, the masterbatch pellets are fed into the extruder section of an injection molding machine. While preferred compositions are made using the materials disclosed herein, it is understood that compositions of the invention can also be made by substituting functionally equivalent materials in quantitites sufficient to achieve substantially similar results. Thus, for example, a foam concentrate comprising an azodicarbonamide might be substituted for the foam concentrate comprising sodium bicarbonate in citric acid within the scope of the invention.

The mold tooling is preferably designed so that when the mold is initially closed, the space within the mold cavity approximately corresponds to the configuration of layers 14a and 14c of end wall 14, side wall 16, pilfer ring 24 and bridges 28 of bottle cap 10. This is advantageously accomplished with mold tooling comprising a mold core defining the interiorly facing walls and a mold cavity portion defining the outwardly facing walls of bottle cap 10. The core portion of the mold tooling is preferably further adapted by means of a retractable insert to slightly increase the volume of that portion of the mold cavity defining end wall 14 during the molding process. As the plastified resin begins to cool within the mold, the insert is retracted, thereby reducing the pressure within that portion of the mold corresponding to end wall 14 of bottle cap 10 sufficiently to permit the foaming agent to expand. As the insert retracts, the relatively cool boundary layer of resin abutting the retracting surface moves with it, forming layer 14c of end wall 14. Behind the boundary layer, the foam concentrate causes the thermoplastic resin to expand into the zone of reduced pressure, thereby forming individual cells of foamed polymer about the nucleator sites. Upon completion of cooling, these cells of foamed polymer define layer 14b of end wall 14. The relative thickness of layers 14a, 14b and 14c will therefore vary according to the polymer composition, the pressure within the mold cavity before and after retraction of the insert, the degree of cooling prior to and during retraction of the insert, and the distance the insert is retracted. Also, while the bottle cap disclosed herein is made through use of a retractable surface on the core side of the mold, it should also be understood that closures can also be made by utilizing retractable surfaces on the cavity side of the mold.

If the surface of the retractable insert is coextensive with the inwardly facing surface of layer 14c of bottle cap 10, layer 14b formed by the expansion of resin into the zone of reduced pressure will create a continuous layer of foamed polymer spanning the inside circumference of bottle cap 10. On the other hand, if the surface of the retractable insert is an annulus, layer 14b will comprise a circumferentially extending annular "doughnut" of foamed polymer separating layers 14a and 14c except in the central portion of end wall 14 of bottle cap 10.

Figure 3:
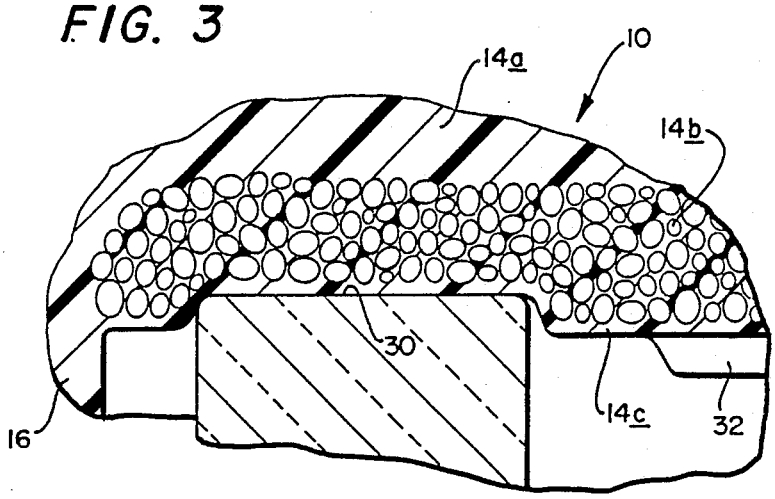
FIG. 3 is a detail view depicting an enlarged portion of the sectional view in FIG. 1 to better illustrate the foamed polymer layer of the invention and the line of contact between the bottle cap and the upwardly extending neck of a bottle to which the cap is attached.

Referring to FIGS. 1 and 3, it is seen that when bottle cap 10 is tightly applied to bottle neck 12, top edge 30 of bottle neck 12 exerts force against the surface of layer 14c adjacent thereto. This force causes the foamed polymer cells to compress behind that portion of layer 14c contacting top edge 30, which is evidenced in FIGS. 1 and 3 by the upward deflection of layer 14c adjacent to top edge 30. This effect provides a tight seal between bottle cap 10 and bottle neck 12 as desired.

Figure 2:
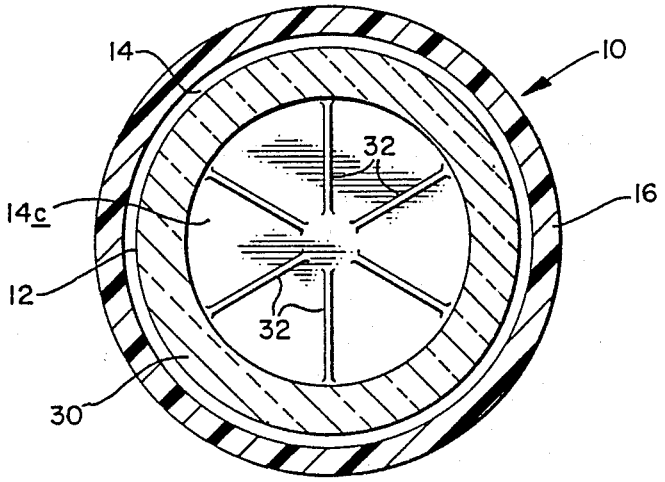
FIG. 2 is a sectional bottom plan view taken along line 2—2 of FIG. 1.

If desired, optional ribs 32 can be incorporated into layer 14c of end wall 14 as shown in FIGS. 1 and 2 by providing correspondingly shaped recesses in the face of the of the tool corresponding to the interiorly facing surface of layer 14c. Such ribs, which are shown emanating radially from near the center of layer 14c in FIG. 2, may assist in further strengthening end wall 14.

To avoid any appreciable foaming of the polymer in side wall 16 (including threads 18), pilfer ring 24 or bridges 28, it is emphasized that all surfaces of both the core and cavity halves of the injection molding tooling except the retractable insert remain locked in fixed relation to each other from the time polymer is first injected into the mold cavity until sufficient cooling has occurred to maintain the dimensional stability of those portions of bottle cap 10 outside the mold.

The container closures disclosed herein exhibit highly desirable strength-to-weight ratios and low bulk densities when compared to other unitarily molded polymeric closures. Depending upon the polymer compositions utilized, the geometry of the closure, and the molding apparatus and procedures, closures can be produced that will satisfactorily confine either gaseous or liquid fluids within a container.

Similarly, while the compositions disclosed herein are preferred for use in molding bottle caps, it will be understood and appreciated upon reading this disclosure that the compositions of the invention can be similarly useful for molding other polymeric articles. Other advantages of the subject closures and various alterations and modifications of the compositions disclosed herein will become apparent to those of ordinary skill in the art upon reading the present disclosure, and it is intended that the present invention be limited only by the broadest interpretation of the appended claims to which the inventor may be legally entitled.

What is claimed is:

1. A molded polymeric container closure comprising: A major portion of moldable polypropylene resin; from about 1.25 to about 6 parts per hundred of resin (pphr) foam concentrate; from about 0.15 to about 1 pphr calcium carbonate; from about 0.03 to about 0.15 pphr amorphous silicon dioxide; from about 0.1 to about 0.4 pphr lubricant selected from the group consisting of synthetic waxes and distilled monoglycerides; from about 0.1 to about 0.4 pphr lubricant selected from the group consisting of N,N'-dioleoylethylenediamine and calcium stearoyl-2-lactylate; from about 0.15 to about 0.3 pphr unsaturated fatty monoamide; and from about 0.5 to about 2 pphr titanium dioxide concentrate.

2. The closure of claim 1 wherein said polypropylene resin is an impact polypropylene resin.

3. The closure of claim 1 wherein said foam concentrate further comprises sodium bicarbonate and citric acid.

4. The closure of claim 3, comprising about 3 pphr foam concentrate further comprising sodium bicarbonate and citric acid.

5. The closure of claim 1, comprising about 0.2 pphr calcium carbonate.

6. The closure of claim 1, comprising about 0.1 pphr amorphous silicon dioxide.

7. The closure of claim 1, comprising about 0.2 pphr synthetic wax.

8. The closure of claim 1, comprising about 0.1 pphr distilled monoglyceride.

9. The closure of claim 1, comprising about 0.2 pphr N,N'-dioleoylethylenediamine.

10. The closure of claim 1, comprising about 0.1 pphr calcium stearoyl-2-lactylate.

11. The closure of claim 1, comprising about 0.25 pphr unsaturated fatty monoamide.

12. The closure of claim 1, comprising about, 1 pphr titanium dioxide concentrate.

13. The closure of claim 1 wherein said closure comprises integrally molded polymeric end and side walls, said end wall further comprising a first layer having a density substantially the same as the density of said side wall and a second relatively less dense foamed layer that is formed in situ.

* * * * *